US007285914B2

(12) United States Patent
Jeon

(10) Patent No.: US 7,285,914 B2
(45) Date of Patent: Oct. 23, 2007

(54) PLASMA DISPLAY PANEL (PDP) HAVING PHOSPHOR LAYERS IN NON-DISPLAY AREAS

(75) Inventor: Byung-Soo Jeon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 171 days.

(21) Appl. No.: 10/981,549

(22) Filed: Nov. 5, 2004

(65) Prior Publication Data

US 2005/0104519 A1 May 19, 2005

(30) Foreign Application Priority Data

Nov. 13, 2003 (KR) ..... 10-2003-0080282
Nov. 27, 2003 (KR) ..... 10-2003-0085117

(51) Int. Cl.
*H01J 17/49* (2006.01)

(52) U.S. Cl. ..... 313/587; 313/582

(58) Field of Classification Search ..... 313/485, 313/582–587

See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda
5,786,794 A 7/1998 Kishi et al.
5,921,836 A 7/1999 Nanto et al.
5,952,782 A 9/1999 Nanto
RE37,444 E 11/2001 Kanazawa (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph Williams
*Assistant Examiner*—Bumsuk Won
(74) *Attorney, Agent, or Firm*—Robert E. Bushnell, Esq.

(57) ABSTRACT

A Plasma Display Panel (PDP) which enables optimization of a process to apply phosphor paste in order to achieve mass production using a nozzle jet method includes dummy areas structured in such a manner to determine whether or not applying conditions such as an ejecting pressure or the like are stable by measuring a depth of the applied layer after applying phosphor paste at a portion thereof in advance. The PDP includes: a first substrate and a second substrate opposing each other; address electrodes arranged on the first substrate; display electrodes arranged on the second substrate along a direction perpendicular to the address electrodes; barrier ribs arranged in a space between the first substrate and the second substrate to define a plurality of discharge cells, and phosphor layers arranged in each of the discharge cells.

10 Claims, 7 Drawing Sheets

U.S. PATENT DOCUMENTS

| | | | | |
|---|---|---|---|---|
| 6,538,380 | B1 * | 3/2003 | Kanagu et al. | 313/582 |
| 6,630,916 | B1 | 10/2003 | Shinoda | |
| 6,707,436 | B2 | 3/2004 | Setoguchi et al. | |
| 6,853,137 | B2 | 2/2005 | Asano et al. | |
| 2002/0195940 | A1 * | 12/2002 | Asano et al. | 313/586 |
| 2004/0201351 | A1 * | 10/2004 | Woo et al. | 313/582 |

FOREIGN PATENT DOCUMENTS

| | | |
|---|---|---|
| JP | 2845183 | 10/1998 |
| JP | 2917279 | 4/1999 |
| JP | 2000-306512 | 11/2000 |
| JP | 2001-35381 | 2/2001 |
| JP | 2001-043804 | 2/2001 |
| JP | 2001-325888 | 11/2001 |
| KR | 10-1999-0082911 | 11/1999 |
| KR | 2001-0051849 | 6/2001 |

* cited by examiner

PLASMA DISPLAY PANEL (PDP) HAVING PHOSPHOR LAYERS IN NON-DISPLAY AREAS

CLAIM OF PRIORITY

This application makes reference to, incorporates the same herein, and claims all benefits accruing under 35 U.S.C. §119 from an applications entitled PLASMA DISPLAY PANEL earlier filed in the Korean Intellectual Property Office on 13 Nov. 2003 and 27 Nov. 2003 and there duly assigned Serial Nos. 10-2003-0080282 and 10-2003-0085117 respectively.

BACKGROUND OF THE INVENTION

1. Field of the Invention

The present invention relates to a plasma display panel, and more particularly, to a plasma display panel having phosphor layers disposed differently on display areas and non-display areas thereof. The present invention also relates to a method of manufacturing a plurality of plasma display panels on one base plate.

2. Description of the Related Art

Generally, a plasma display panel, referred to hereinafter as a "PDP", displays images based on a plasma discharge. When voltages are applied to electrodes arranged at discharge regions of the PDP, a plasma discharge occurs between the electrodes to generate ultraviolet rays. The ultraviolet rays excite phosphor layers arranged in a predetermined pattern to display desired images.

In fabricating such a PDP, a plurality of barrier ribs are formed and phosphor layers are formed thereon. Presently, photolithography, screen-printing, or like are used as methods of forming phosphor layers.

However, when fabricating high definition PDPs or PDPs having closed barrier ribs, there are many problems in using a screen printing method or the like due to a narrow pitch of the plasma discharge cells. Also, although an inkjet method or a photolithography method has been developed and used, these methods may be not suitable for mass production of PDPs due to the complex production processes required.

Recently, a so-called method for taking many faces, hereafter referred to as a "process for taking many faces", has been applied in order to achieve mass production of PDPs. The method involves forming a plurality of PDP structures on one mother substrate, and then cutting out individual PDPs therefrom. However, this method has many problems, such as the unnecessary consumption of time and materials, when used with a conventional screen printing or photolithography method to produce PDPs.

SUMMARY OF THE INVENTION

It is therefore an object of the present invention to provide an improved design for a PDP.

It is also an object of the present invention to provide a PDP which enables optimizing a process for applying a phosphor paste, and to achieve mass production of PDPs using a nozzle jet method.

These and other objects can be achieved by a PDP with a dummy area formed so as to confirm that the conditions to apply the phosphor paste, such as an ejecting pressure or the like, are stable, by measuring a depth of the phosphor layer while applying phosphor paste in advance at a portion of the dummy area.

The PDP according to one embodiment of the present invention includes a first substrate and a second substrate opposing each other, address electrodes formed on the first substrate, display electrodes formed on the second substrate along a direction perpendicular to the address electrodes, barrier ribs arranged in a space between the first substrate and the second substrate to define a plurality of discharge cells, and phosphor layers formed in each of the discharge cells.

A display area includes a plurality of the discharge cells formed at a location where the address electrodes and the display electrodes cross each other, and a non-display area formed adjacent to an edge of the display area, along a direction perpendicular to a direction in which phosphor layers of the same color are applied to discharge cells neighboring each other and the phosphor layers are applied to portions of the non-display area.

The depth of the phosphor layer formed in the non-display area gradually increases toward the display area, and the mean depth of the phosphor layers formed in the display area is different from the mean depth of the phosphor layers formed in the non-display area, and preferably, the mean depth of the phosphor layers formed in the display area is greater than that of the phosphor layers formed in the non-display area.

Alternatively, the barrier ribs of the non-display area are connected to the barrier ribs of the display area and are parallel to the direction in which the phosphor layers of the same color are applied.

The barrier ribs of the non-display area include other barrier ribs perpendicular to the direction in which the phosphor layers of the same color are applied.

The non-display area is interposed between two display areas. A nozzle jet apparatus having a plurality of nozzles can apply the phosphor paste.

The non-display area can have a width in a range of from 2 mm to 3.5 mm along the direction in which phosphor layers of the same color are applied.

Another aspect of the present invention provides a method of manufacturing a plurality of plasma display panels on one base plate, in which a plasma display panel includes discharge cells arranged between first and second substrates, phosphor layers formed therein, and address electrodes and display electrodes corresponding to each discharge cell.

In this method, forming the phosphor layers further includes: arranging a plurality of nozzles above each of the discharge cells arranged between barrier ribs neighboring each other at an edge of the one base plate; moving the plurality of nozzles along a direction in which phosphor layers of the same color are to be applied to the discharge cells; ejecting a certain amount of phosphor paste in one portion of the base plate corresponding to one of the plurality of plasma display panels and ceasing ejecting phosphor paste in another portion thereof adjacent to the one portion; and firing the phosphor layers.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
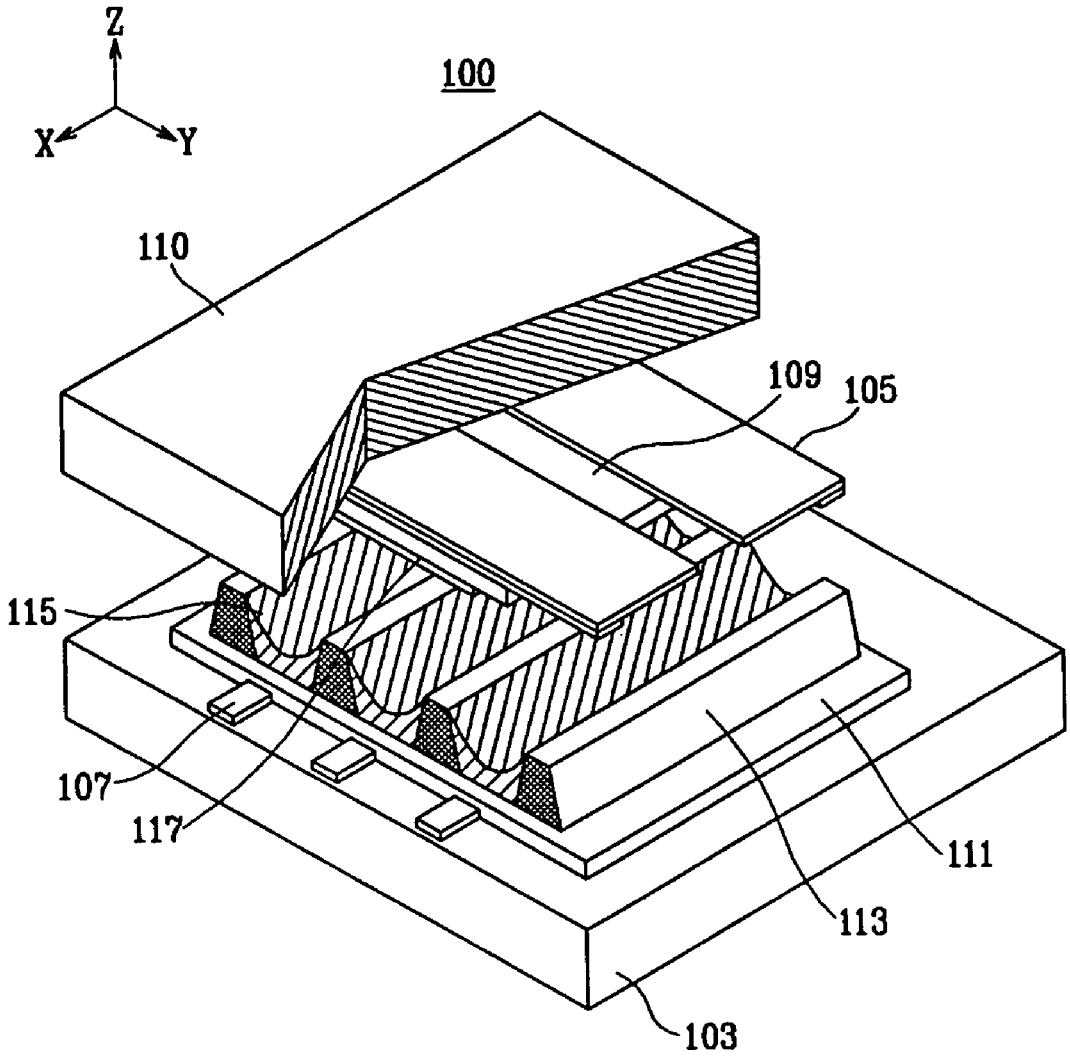
FIG. 1 is an exploded perspective view of a plasma display panel.

There are different types of PDPs including AC-PDPs, DC-PDPs, and hybrid PDPs. FIG. 1 is a partial exploded perspective view of an AC-PDP with a matrix barrier rib configuration. With reference to FIG. 1, an AC-PDP 100 includes a rear substrate 103, address electrodes 107 formed on the rear substrate 103, a dielectric layer 111 formed on an entire surface of the rear substrate 103 covering the address electrodes 107, a plurality of barrier ribs 113 formed over the dielectric layer 111 to maintain a constant discharge distance therebetween and to prevent the occurrence of cross-talk among the cells, and phosphor layers 115 formed between each of the neighboring barrier ribs 113. A plurality of display electrodes 105 are formed on a front substrate 110 and are arranged in pairs and spaced apart from each other and correspond to one discharge cell when they intersect the address electrodes 107 formed on the rear substrate 103. A dielectric layer 109 and a protective layer 117 are formed sequentially to cover the display electrodes 105. An inert gas such as Ne, Xe, or the like is injected into the discharge cells.

With the above-structured PDP, when a high voltage is applied to the display electrodes 105, ultraviolet rays are generated by the inert gas, which excite the phosphors of the phosphors layer 115 to produce images.

Figure 2:
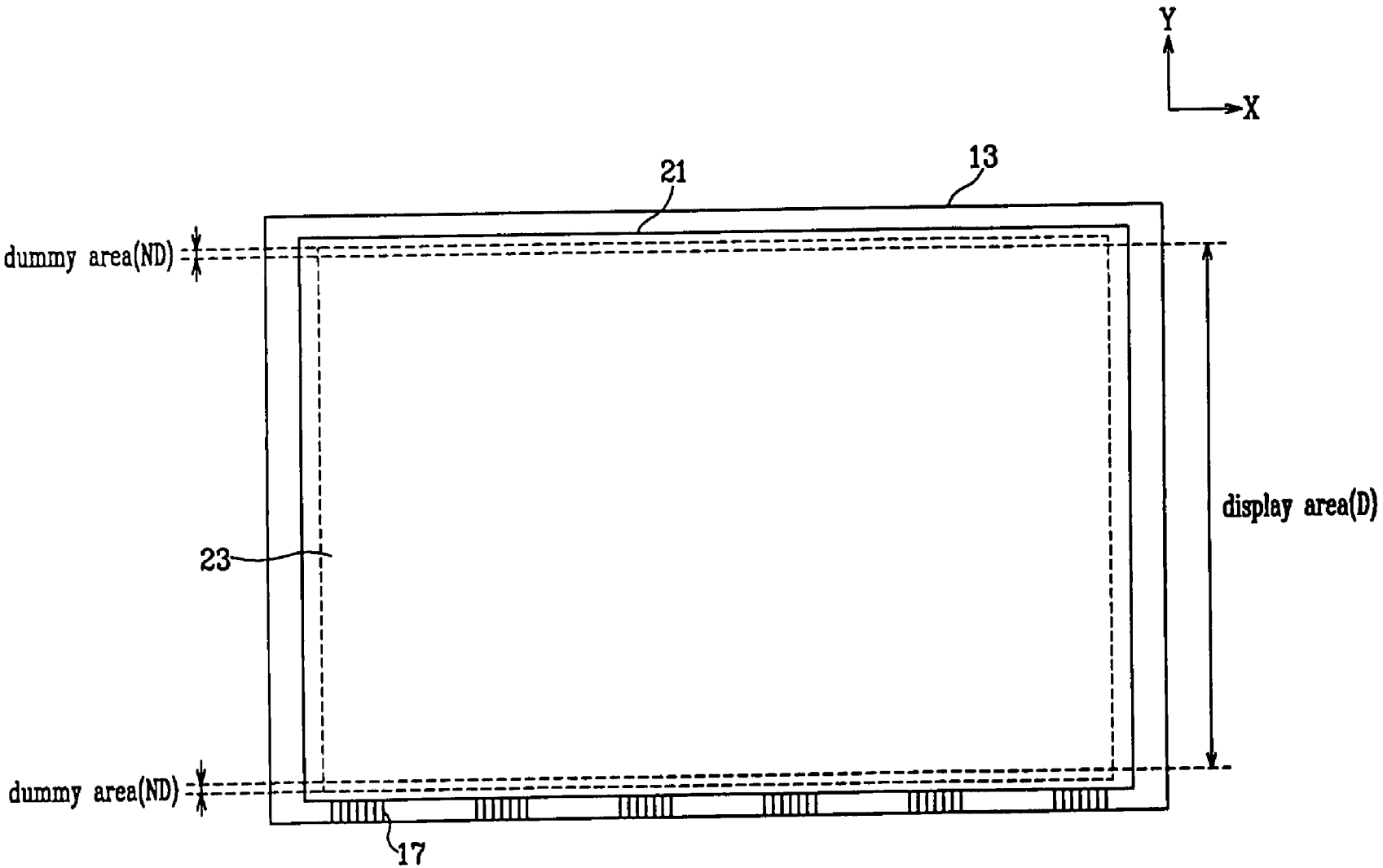
FIG. 2 is a plane view of a rear plate of a plasma display panel according to an embodiment of the present invention.
Figure 3:
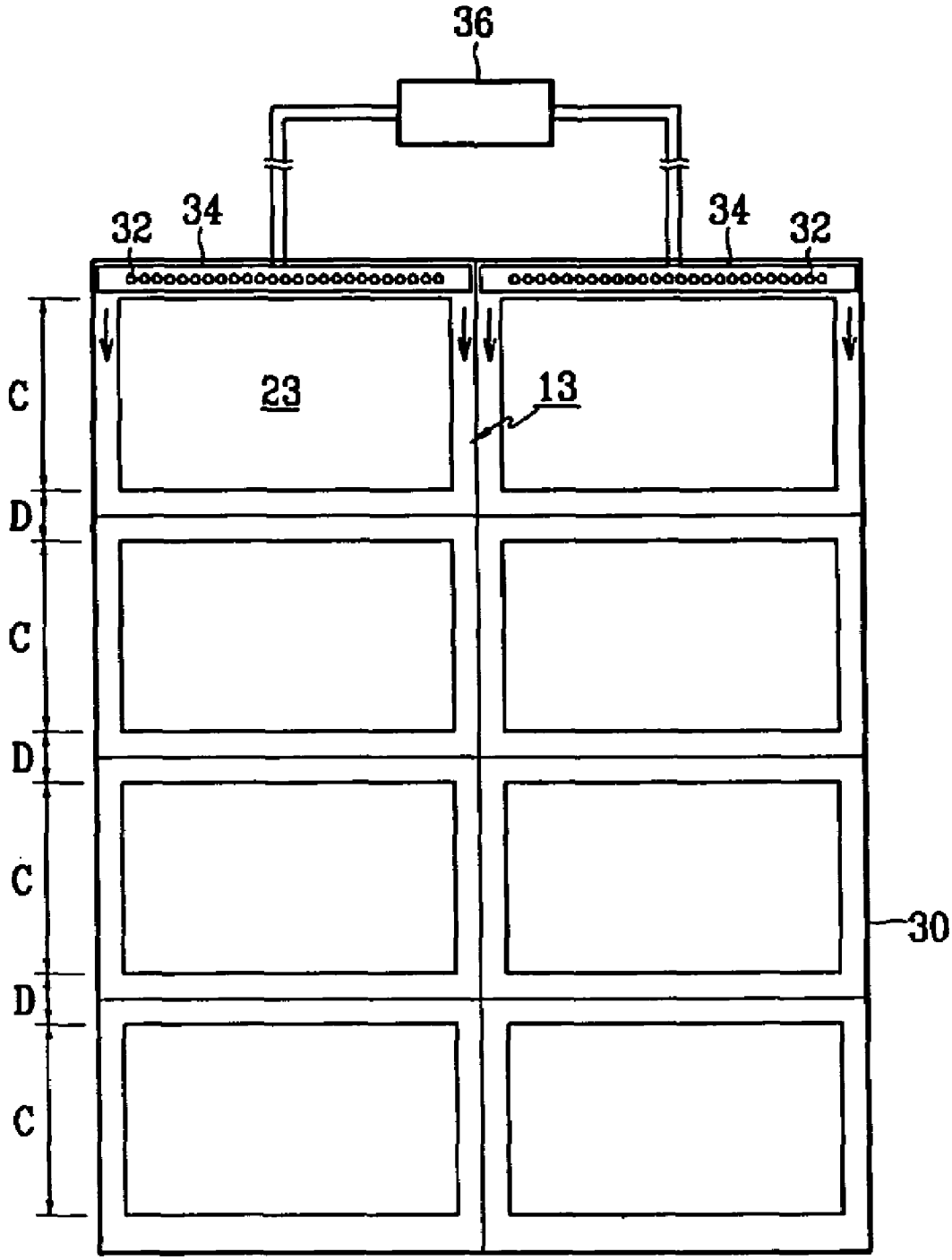
FIG. 3 is a view of a process for taking many faces in order to manufacture a plurality of plasma display panels according to an embodiment of the present invention.

FIG. 2 is a plane view of a rear plate of a plasma display panel according to an exemplary embodiment of the present invention, and FIG. 3 is a schematic view of a process for taking many faces in order to manufacture a plurality of plasma display panels according to an embodiment of the present invention.

In this embodiment, a plurality of address electrodes 17 are formed (along the Y direction of FIG. 2) on a substrate 13, and a dielectric layer 21 and a plurality of barrier ribs 23 are subsequently formed thereon. Then, red, green, and blue phosphor paste (not shown) is applied between the neighboring barrier ribs and fired.

A plurality of display electrodes, not shown in FIG. 2, are formed along a direction perpendicular to the direction of the address electrodes 17 on the other substrate, and a dielectric layer and MgO protective layer, also not shown in FIG. 2, are formed sequentially to cover the display electrodes. Thereafter, frit is applied along the edges of both substrates and is fired to join them in an air-tight fashion. Finally, an inert gas such as Ne, Xe, or the like is injected into above-structured arrangement to complete the PDP according to the present invention.

With the above-structured PDP, a high voltage is applied to the display electrodes (not shown) and the address electrodes to generate a discharge therebetween and to accumulate wall charges in the dielectric layer (not shown). Ultraviolet rays are generated by the plasma phase of the inert gas, which excite the phosphors of the phosphor layer to produce images.

That is, when sustain pulse signals are alternatively applied to the display electrodes, sustain discharges occur in the discharge cell selected by the address discharge. As a result, the discharge gas in the discharge cells is excited to generate the ultraviolet rays, and these ultraviolet rays excite phosphors to produce images.

As shown in FIG. 2, in the PDP according to an embodiment of the present invention, address electrodes 17 cross display electrodes to form image pixels, and these image pixels come together to form a display area D. A non-display area ND is formed adjacent to the display area D between each of the display areas D.

Since the non-display area is used to protect the barrier ribs from collapsing when forming the barrier ribs, it is independent of the plasma discharge. Accordingly, in FIG. 2, the non-display area is indicated as a dummy area. The dummy area ND has either address electrodes or display electrodes that do not generate a plasma discharge. In this embodiment, at the dummy area ND, a phosphor paste is applied uniformly between neighboring barrier ribs after forming the barrier ribs. The dummy area is used to confirm whether a condition for applying the phosphor paste, such as an ejecting or discharge pressure or the like, is stable by measuring the depth of the phosphor layers formed in advance on a portion of the dummy area. If the phosphor paste is applied in advance on a portion of the dummy area, the phosphor paste can be applied and adhere to the display area to reduce the number of floating phosphor particles. Therefore, the possibility of mis-discharges occurring is reduced.

As shown in FIG. 2, although dummy areas ND are formed on both sides of a display area D along the direction of address electrodes 17, a dummy area can be formed on either side of the display area D, where a process for applying phosphor paste begins.

With reference to FIG. 3, in a process for taking a plurality of faces, a plurality of PDP substrates are fabricated on one mother substrate (herein, the PDPs can have more than one size), and phosphor layers are formed on the substrates by a nozzle jetting method. Accordingly, a jet head 34 having a plurality of nozzles 32 is located and moves along one direction during which phosphor paste of the same color is applied above the barrier ribs 23, and each of the nozzles 32 are arranged corresponding to a row of discharge cells formed between the neighboring barrier ribs 23.

The jet head 34 is connected to a tank 36 for holding phosphor paste, and is supplied with compressed air so as to eject the phosphor paste through the nozzles.

When the jet head 34 move along the one direction and ejects a certain amount of phosphor paste to form the phosphor layers, it ejects phosphor paste at one portion (an ejecting area C) of the base plated glass corresponding to one PDP, and stops ejecting phosphor paste at another portion (a stop area R) thereof adjacent to the one portion.

In this process, the jet head 34 is not initially capable of uniformly ejecting the phosphor paste through the nozzles 32, but after a preparation time, that is, a time necessary to stabilize an ejecting amount of phosphor paste, the phosphor paste is ejected uniformly and sufficiently. This step for stabilizing an ejecting amount of phosphor paste is referred to as a preparation step. The preparation step is when the phosphor paste is applied to the dummy area ND of FIG. 2.

Figure 4:
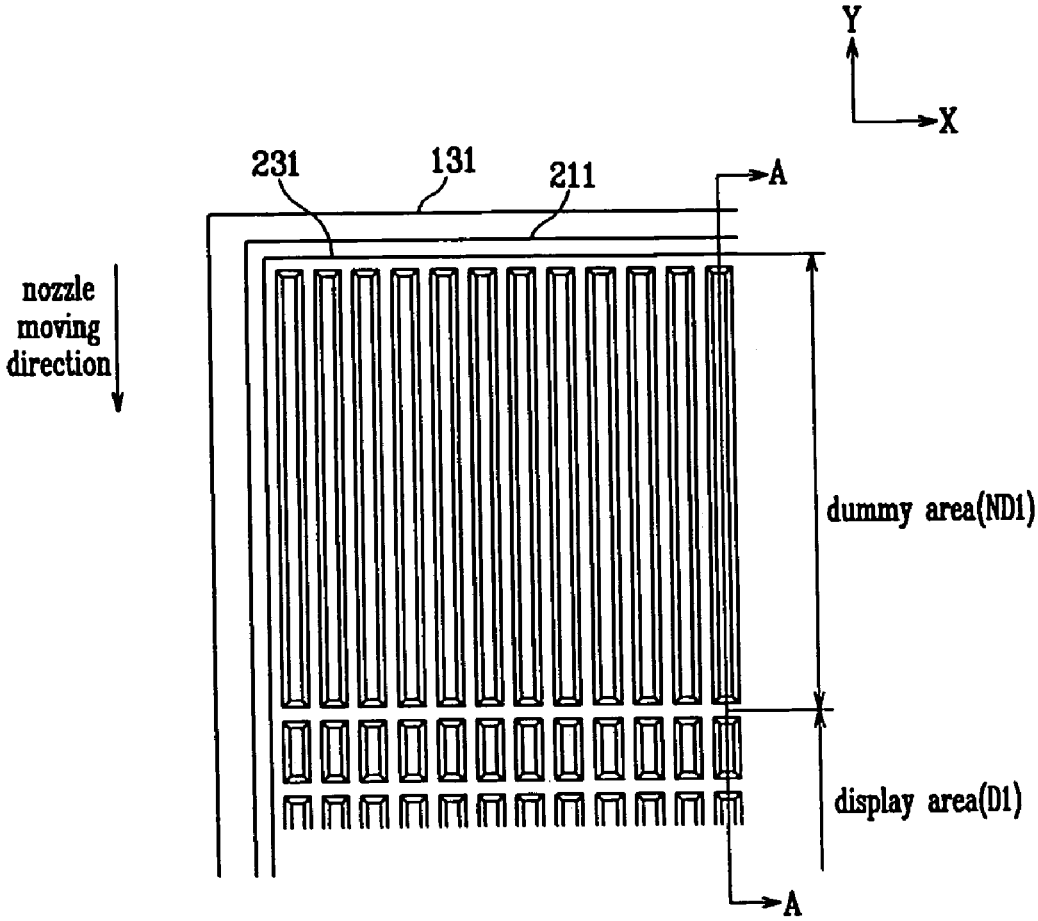
FIG. 4 is a partial enlarged plane view of a rear plate of a plasma display panel according to an embodiment of the present invention.

FIG. 4 is a partial enlarged plane view of a rear plate of a plasma display panel according to an embodiment of the present invention.

With reference to FIG. 4, in the PDP according to an embodiment of the present invention, address electrodes (not shown) are formed on one substrate, and a dielectric layer 211 and barrier ribs 231 are formed in order while covering the address electrodes. Particularly, in this embodiment, barrier ribs formed in a dummy area ND1 are continuously connected to striped barrier ribs formed in display area D1 along the direction in which phosphor layers of the same color are formed. The continuously striped barrier ribs have an advantage in that it is easy to determine an ejecting amount of phosphor paste in the dummy area.

Figure 5:
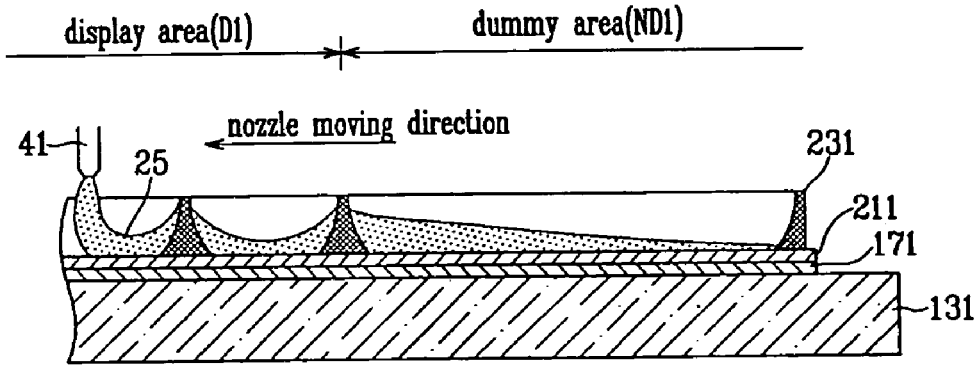
FIG. 5 is a cross-sectional view taken along line A-A of FIG. 4, of a process for applying phosphor paste.

FIG. 5 is a cross-sectional view taken along line A-A of FIG. 4, of a process for applying phosphor paste.

With reference to FIG. 5, the nozzles 41 go past the dummy area ND1 and then the display area D1 along the arrow direction to apply the phosphor paste at these two areas. The amount of phosphor paste ejected through the nozzles 41 gradually increases in the dummy area ND1 from the start, and ultimately reaches a constant amount at the display area D1, so the nozzle jet apparatus forms phosphor layers 25 of a uniform depth. The amount of phosphor paste ejected through the nozzles 41 can be gradually reduced again, after the nozzle jet apparatus passes though the display area D1 and reaches a dummy area at the opposite side (not shown in FIG. 5).

In FIG. 5, the depth of the phosphor layer formed in the dummy area ND1 gradually increases, and the depth thereof in the display area D 1 becomes uniform. As a result, the depth of the phosphor layer formed in the non-display area increases toward the display area, and the mean depth of the phosphor layer formed in the display area is different from that of the phosphor layer formed in the non-display area, i.e., thicker.

Figure 6:
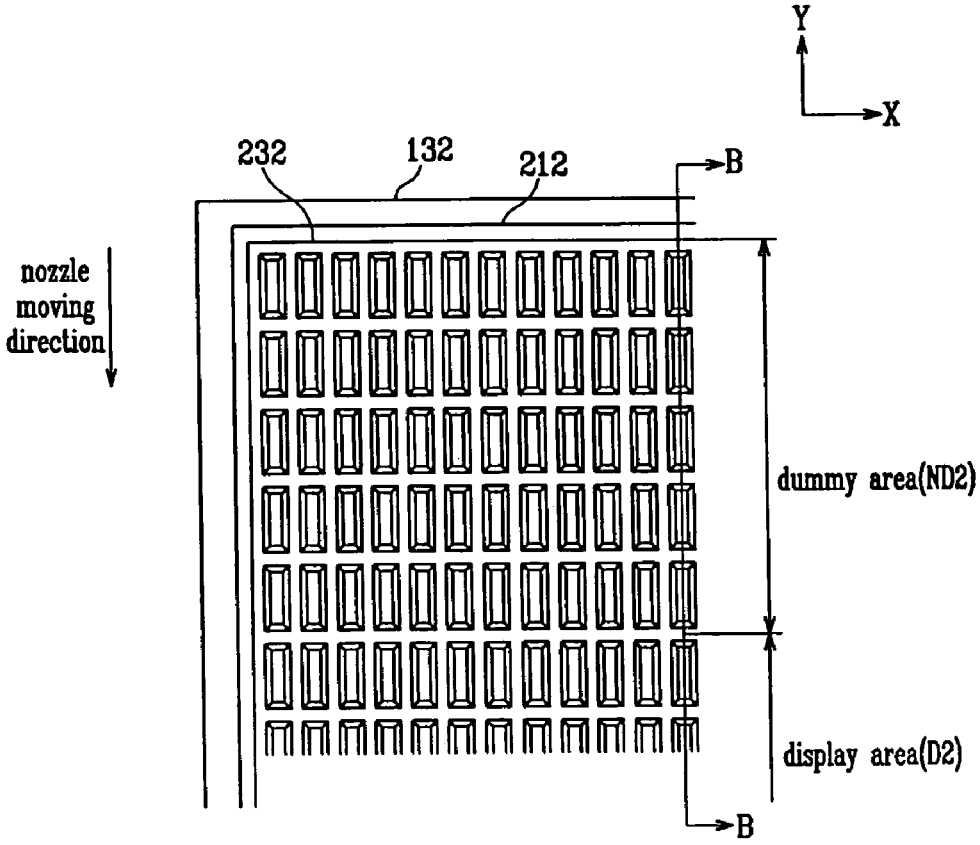
FIG. 6 is a partial enlarged plane view of a rear plate of a plasma display panel according to an embodiment of the present invention.

FIG. 6 is a partial enlarged plane view of a rear plate of a plasma display panel according to a second embodiment of the present invention.

A plasma display panel according to a second embodiment of the present invention shown in FIG. 6 is similar to that according to the first embodiment shown in FIG. 4, except that it has barrier ribs in a dummy area ND2. That is, in this embodiment, the barrier ribs formed in the dummy area ND2 run from the barrier ribs formed in the display area D2 along the direction in which phosphor layers of the same color are applied, and the others are formed in parallel along a direction that is perpendicular to the direction of the address electrodes to form a closed structure. Therefore, the forming of the barrier ribs is simplified in that additional processes to form dummy area are not required.

Figure 7:
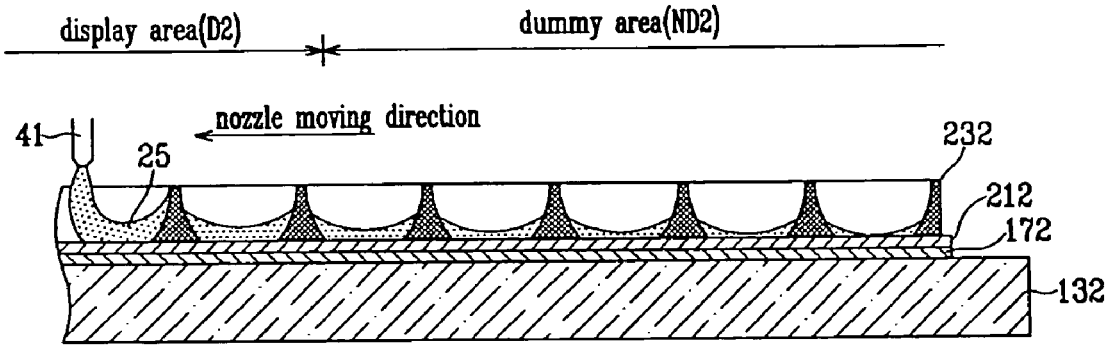
FIG. 7 is a cross-sectional view taken along line B-B of FIG. 6, of a process for applying phosphor paste.

FIG. 7 is a cross-sectional view taken along line B-B of FIG. 6, of a process for applying phosphor paste.

With reference to FIG. 7, nozzles 41 go past the dummy area ND2 and then the display area D2 along the arrow direction to apply phosphor paste 25 to these two areas. The amount of phosphor paste ejected through the nozzles 41 gradually increases in the dummy area ND2 from the start and ultimately reaches a constant amount in the display area D2, so the nozzle jet apparatus forms phosphor layers 25 of a uniform depth. The amount of phosphor paste ejected through the nozzles 41 can be gradually reduced again, after the nozzle jet apparatus passes though the display area D2 and reaches a dummy area at the opposite side (not shown in FIG. 7).

In FIG. 7, the depth of the phosphor layer applied in the dummy area ND2 gradually increases, and the depth thereof in the display area D2 become uniform. As a result, the depth of the phosphor layer formed in the non-display area increases toward the display area, and the mean depth of the phosphor layer formed in the display area is different from that of phosphor layer formed in the non-display area, i.e., thicker.

Figure 8:
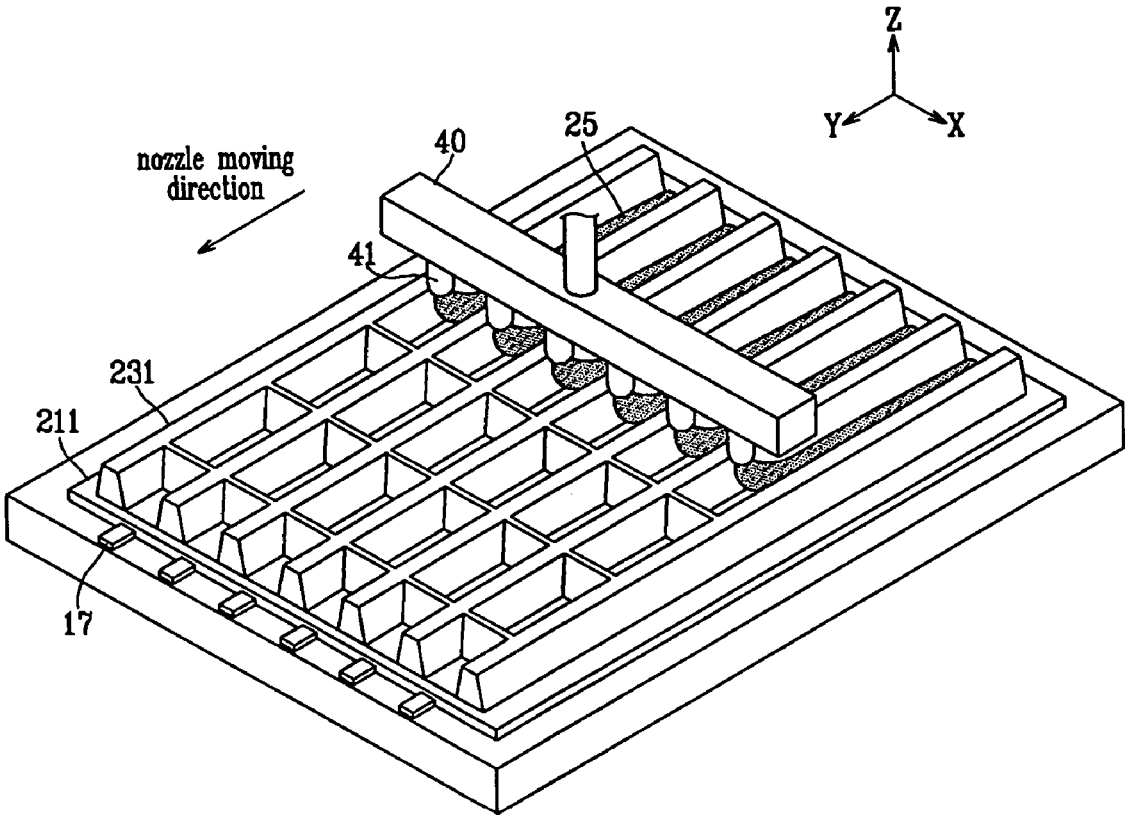
FIG. 8 is a perspective view of a process for applying phosphor paste in the plasma display panel according to an embodiment of the present invention.

FIG. 8 is a perspective view of a process for applying phosphor paste in the plasma display panel according to an embodiment of the present invention.

Recently, the demand for PDPs has been increasing exponentially. To this end, a process for manufacturing a large PDP has been needed, and the present invention employs a nozzle applying method that is suitable to do so. In more detail, in FIG. 8, a nozzle jet apparatus having a plurality of nozzles 41 is used. The nozzle jet apparatus operates up and down as well as right and left over the entire substrate to sequentially apply phosphor paste between the barrier ribs 231.

Particularly, to manufacture a large PDP, it is preferable that the dielectric layer and barrier ribs are formed along the direction of the address electrodes at the same time. Accordingly, the dielectric layer and barrier ribs for a plurality of plasma display panels formed in one base plate glass can be formed while being continuously connected. Also, barrier ribs formed in a non-display area adjacent to one display area can run to the end of the other display area along the direction of the address electrodes. The non-display area can be formed on one side or both sides of the PDPs, according to the number of PDPs being manufactured.

Phosphor paste is automatically supplied to the nozzle jet apparatus from a tank (not shown), and it flows through the nozzle by operating a piston valve and is applied to discharge cells defined by the barrier ribs. The nozzle 41 has an orifice at one end thereof with a diameter of 50 mm. On beginning to apply the phosphor paste, if the orifice is open so as to suction air, a uniform pressure is formed in the nozzle. The air pressure and a jet velocity remain in a range from 0.5 to 0.6 MPa and 110 m/s, and the distance between the top surface of the barrier ribs and the lower end of the nozzle is no more than 200 μm so as to apply the phosphor paste to the correct site. In the nozzle jet apparatus 40 according to the embodiment of the present invention, the ejecting amount and uniformity of the phosphor paste is controlled only by air pressure.

Figure 9A:
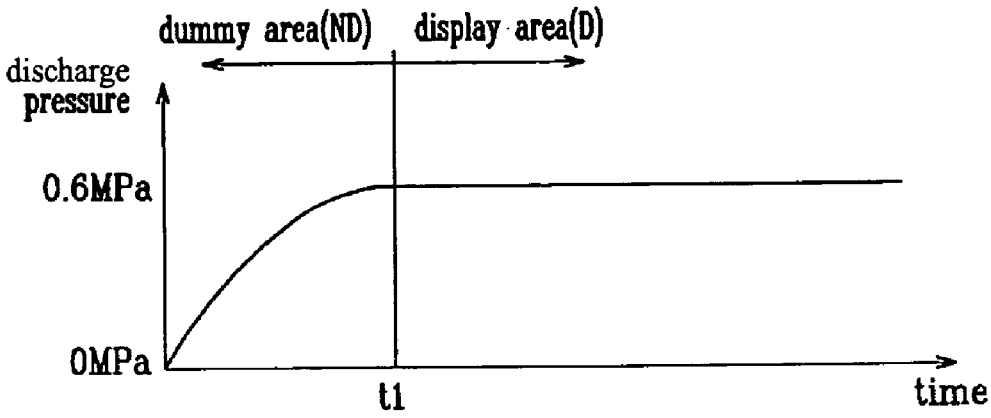
FIGS. 9A and 9B are respectively a graph of the relationship of depth of the phosphor layer and the discharge pressure of a nozzle with respect to the time of applying the phosphor paste according to an exemplary embodiment of the present invention.
Figure 9B:
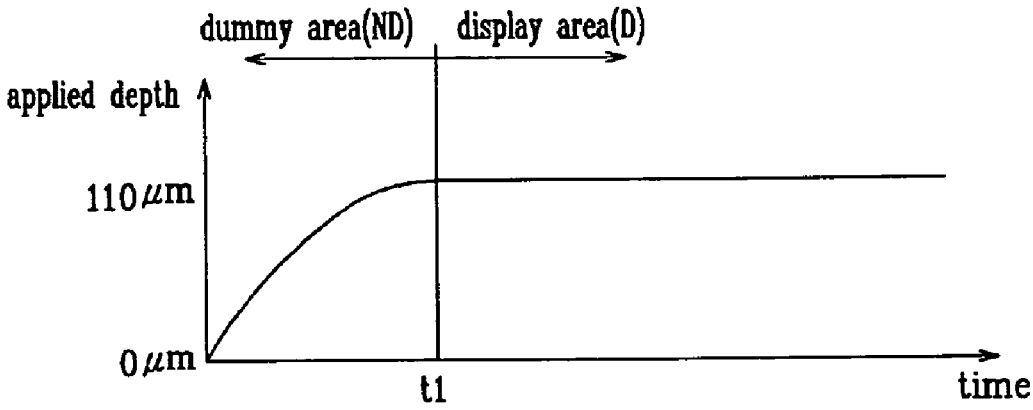

FIGS. 9A and 9B are graphs respectively showing an ejecting pressure of the nozzle and an applied depth of the phosphor paste with respect to time on applying the phosphor paste to the plasma display panel according to an embodiment of the present invention, which in more detail describes a controlling method of the nozzle jet apparatus 40.

If the ejecting pressure of the nozzle becomes 0.6 MPa as shown in FIG. 9A, the phosphor paste is applied uniformly so that the applied depth thereof becomes uniform to a depth of approximately 110 μm as shown in FIG. 9B.

As shown in FIG. 9A and FIG. 9B, the phosphor paste is first applied roughly at the dummy area (ND), and the ejecting pressure of the nozzle and the applied depth thereof gradually increase as time passes until ultimately the phosphor paste is applied uniformly at the display area (D).

Particularly, it is preferable that the length of the dummy area ND along the applying direction of the phosphor paste is from 2 mm to 3 mm. Since a cell pitch is about 693 μm, preferably, the dummy area ND comprises three or more cells, and more preferably, the dummy area ND can be designed to have five cells. If the length of the dummy area is below 2 mm, the phosphor paste is not applied uniformly to the display area. That is to say, since there is not sufficient time (t1) to stabilize the applying of the phosphor paste, the phosphor paste is not applied uniformly. Also, it is preferable that the length of the dummy area is less than 3.5 mm considering the length of the substrate and display area.

As described above, according to the embodiment of the present invention, since the non-display area having the phosphor paste partially applied thereto is formed adjacent to the display area along the direction having phosphor layers of the same color, the amount of phosphor paste applied to the display area can be estimated in advance so that the phosphor paste is uniformly applied to the display area. In addition, if the phosphor paste is fired after being applied, the phosphor particles adhere to the barrier ribs to reduce the floating particles and thereby reduce the possibility of mis-discharges or the like occurring. Also, since the phosphor paste can be selectively applied to a portion of the non-display area, a process for applying the phosphor paste can be achieved flexibly.

The dummy area is used to determine whether or not an application condition such as an ejecting pressure or the like is stable by measuring a depth of the applied layer after applying the phosphor paste to a part of the dummy area in advance. If the phosphor paste is applied in advance to a portion of the dummy area, the phosphor paste is well applied and adhered to the display area to reduce the number of floating phosphor particles. Therefore, the possibility of mis-discharges is reduced.

If the barrier ribs in the non-display area are formed continually in a stripe pattern along the direction of applying the phosphor paste of the same color such that they interlink with the barrier ribs formed in the display area, the increasing state of the depth of phosphor layers can be confirmed.

Also, since the barrier ribs can be composed of a plurality of further barrier ribs formed along a direction perpendicular to the direction of applying the phosphor paste of the same color, it is advantageous in that forming the barrier ribs is simplified and can be formed in the same manner as in forming the display area.

The present invention is suitable to form a plurality of PDPs on one glass substrate.

In this embodiment, since the phosphor paste is applied by the nozzle jet apparatus, the phosphor paste can be more finely applied to the closed barrier ribs and the applying time can be shortened, thereby enhancing mass production.

Finally, on accomplishing the mass production of the PDPs by the method for forming a plurality of faces, the quality of the phosphor layers of the PDPs is improved so that the quality of the finished product can be enhanced.

Although embodiments of the present invention have been described in detail hereinabove in connection with certain exemplary embodiments, it should be understood that the present invention is not limited to the disclosed exemplary embodiments, but on the contrary is intended to cover various modifications and/or equivalent arrangements included within the spirit and scope of the present invention, as recited in the appended claims.

What is claimed is:

1. A plasma display panel, comprising:

a first substrate and a second substrate opposing each other;

address electrodes arranged on the first substrate;

display electrodes arranged on the second substrate perpendicular to the address electrodes;

barrier ribs arranged in a space between the first substrate and the second substrate to define a plurality of discharge cells; and phosphor layers arranged in each of the plurality of discharge cells;

wherein a display area includes a plurality of the discharge cells arranged at a location where the address electrodes and the display electrodes cross each other;

wherein a non-display area is arranged adjacent to an edge of the display area, along a direction perpendicular to a direction in which phosphor layers of the same color are applied to discharge cells neighboring each other; and wherein the phosphor layers are applied to portions of the non-display area.

2. The plasma display panel of claim 1, wherein the non-display area comprises a plurality of non-discharge cells corresponding to no more than two electrodes.

3. The plasma display panel of claim 1, wherein a depth of the phosphor layers in the non-display area gradually increases in a direction toward the display area.

4. The plasma display panel of claim 1, wherein a mean depth of the phosphor layers in the display area is different from that of the phosphor layers in the non-display area.

5. The plasma display panel of claim 4, wherein the mean depth of the phosphor layers in the display area is greater than that of the phosphor layers in the non-display area.

6. The plasma display panel of claim 1, wherein the barrier ribs of the non-display area are connected to the barrier ribs of the display area and are parallel to the direction in which the phosphor layers of the same color are applied.

7. The plasma display panel of claim 6, wherein the barrier ribs of the non-display area include other barrier ribs perpendicular to the direction in which the phosphor layers of the same color are applied.

8. The plasma display panel of claim 1, wherein the non-display area is interposed between two display areas.

9. The plasma display panel of claim 1, wherein the phosphor layers are applied by a nozzle jet apparatus having a plurality of nozzles.

10. The plasma display panel of claim 1, wherein the non-display area has a width in a range of from 2 mm to 3.5 mm along the direction in which the phosphor layers of the same color are applied.

* * * * *